United States Patent [19]

Betzler et al.

[11] 4,207,709

[45] * Jun. 17, 1980

[54] TOOL GRINDING MACHINE FOR PROFILE TOOLS, ESPECIALLY FOR WOOD AND PLASTIC WORKING MACHINES

[75] Inventors: Otto Betzler, Tauberbischofsheim; Adalbert Künzig, Königheim-Pülfringen, both of Fed. Rep. of Germany

[73] Assignee: Michael Weinig Kommanditgesellschaft, Tauberbischofshem, Fed. Rep. of Germany

[ * ] Notice: The portion of the term of this patent subsequent to May 31, 1994, has been disclaimed.

[21] Appl. No.: 907,400

[22] Filed: May 18, 1978

[30] Foreign Application Priority Data

May 18, 1977 [DE] Fed. Rep. of Germany ..... 2722523

[51] Int. Cl.[2] ..... B24B 3/08

[52] U.S. Cl. ..... 51/100 R

[58] Field of Search ..... 51/100 R, 5 D; 90/13.05, 13.1, 13.2; 409/81, 82

[56] References Cited

U.S. PATENT DOCUMENTS

| | | | |
|---|---|---|---|
| 1,335,351 | 3/1920 | Segal | 51/100 R |
| 2,412,653 | 12/1946 | Ross | 51/100 R |
| 2,477,135 | 7/1949 | Marker et al. | 51/100 R |
| 3,640,024 | 2/1972 | Stahn | 51/5 D X |
| 4,026,073 | 5/1977 | Betzler | 51/100 R |
| 4,092,806 | 6/1978 | Wich | 51/100 R |

*Primary Examiner*—Gary L. Smith
*Assistant Examiner*—Robert P. Olszewski
*Attorney, Agent, or Firm*—Becker & Becker, Inc.

[57] ABSTRACT

A tool grinding machine for profile tools of machines for working wood, plastics material and the like, which includes: a machine stand, at least one headstock arranged on the machine stand and comprising a grinding spindle carrying a grinding wheel, a holding fixture provided for the profile tools to be ground and located opposite to a grinding area provided at a point of the rotational path of the grinding wheel mantle, a grinding rest movably mounted on the machine stand, a copying attachment including a template to be arranged on a holder and also including a tracer finger arranged on the machine stand, for engagement in the profiled template. The headstock is arranged on a swivel support which is adjustable about a swivel axis, which is at least nearly parallel to the grinding spindle and passes approximately through the grinding area of the grinding wheel. The swivel support is mounted on a rotary support arranged on the machine column so as to be adjustable about a pivot which is transverse to the common axial plane of the grinding spindle and the swivel axis. The holding fixture is mounted on a carrier which is pivotally mounted on the machine stand, while the template is located in a plane which passes through the grinding area and incorporates the edge of the profile tool to be ground. The grinding wheel is so mounted that it can be swivelled about an axis which is approximately vertical to the spindle axis and angular to the axis of rotation and passes through the grinding area.

11 Claims, 8 Drawing Figures

TOOL GRINDING MACHINE FOR PROFILE TOOLS, ESPECIALLY FOR WOOD AND PLASTIC WORKING MACHINES

The present invention relates to a tool grinding machine for profile tools of machines working wood, plastics material and the like, which comprises a machine column, and at least one headstock arranged on said machine column. More specifically, the invention relates to a tool grinding machine of the above mentioned type, in which the grinding spindle carries a grinding wheel, and a holding fixture is provided for the profile tools to be ground, which holding fixture is located opposite a grinding area provided at a point of the rotational path of the grinding wheel shell. The said machine column has a grinding rest movably mounted thereon, while a copying attachment is provided which includes a template to be arranged on a holder, and a feeler arranged on said machine column for engaging the profiled template.

On a known tool grinding machine of this kind, the profile tool to be ground is clamped in a holding fixture designed as a grinding mandrel. The holding fixture is provided on a slide rest which can be moved past the grinding wheel with the aid of a parallelogram guide. With this known grinding machine, it is possible to grind clearance angles on the backs of the profile tools, only after a respective readjustment of the grinding machine, especially of the supporting finger. Such readjustments during a grinding operation are time-consuming and expensive and necessitate a very accurate setting which can be carried out only by qualified specialists. The grinding wheel has to be repeatedly re-profiled by means of dressing or has to be replaced if the cutting edges of the profile tools are to be ground with a high degree of accuracy. This increases the expenditure of work and renders the operation of the machine more difficult. This grinding machine is therefore mainly used for the re-grinding of metal-working tools which, in contrast to wood and plastics material working profile tools such as cutter profiles for window frames or cutter profiles for the furniture industry, have relatively simple profiles.

It is, therefore an object of this invention to design a tool grinding machine of the general type mentioned above which will make it possible to grind in a simple manner and in a relatively short time complicated profiles with the desired and necessary clearance angle on the back and on the side of the profile tools.

This object and other objects and advantages of the invention will appear more clearly from the following specification in connection with the accompanying drawings, in which.

Figure 6:
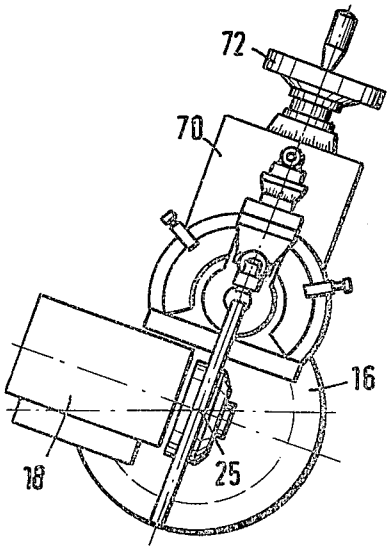
Figure 4:
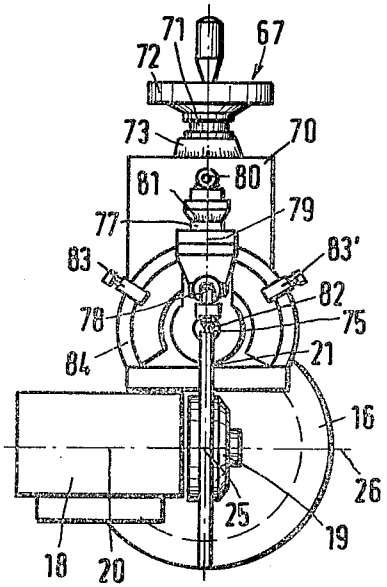
Figure 5:
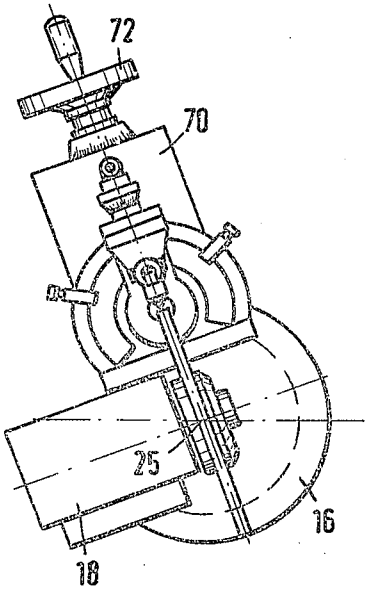

FIGS. 4 to 6 respectively show enlarged illustrations of different swivel positions of a grinding unit of the machine according to the invention.

Figure 7:
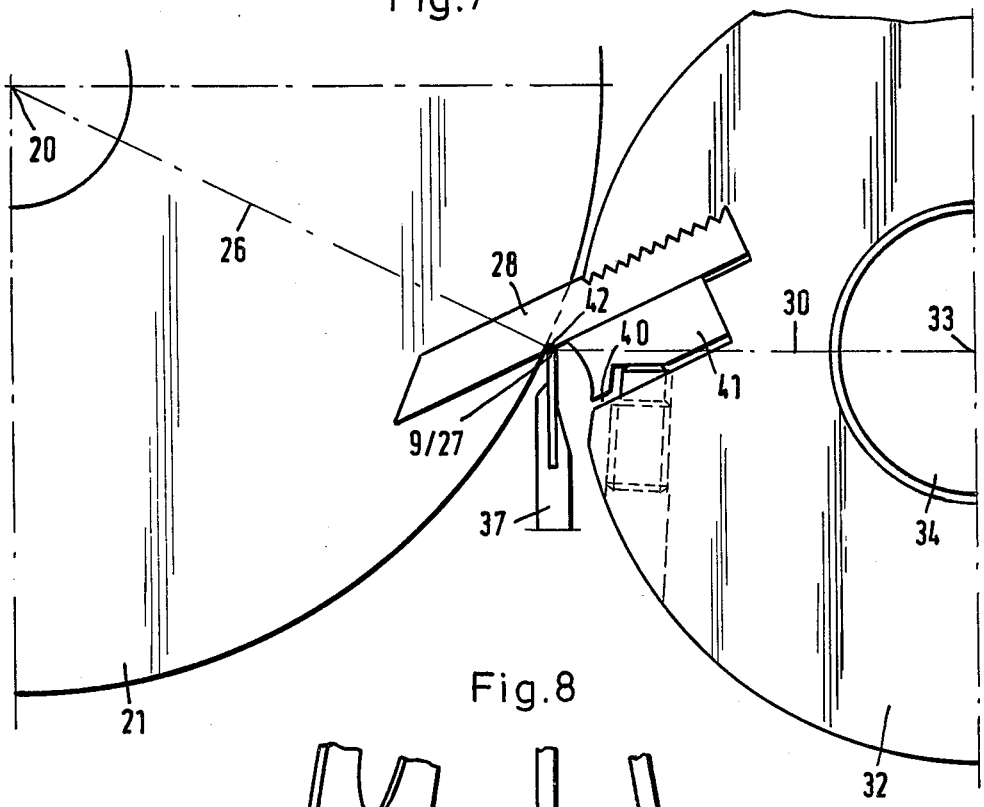

FIG. 7 illustrates on an enlarged scale a portion of the grinding wheel and a portion of the holding fixture with the profile tool to be ground as well as the grinding wheel swivel point and a supporting finger.

Figure 8:
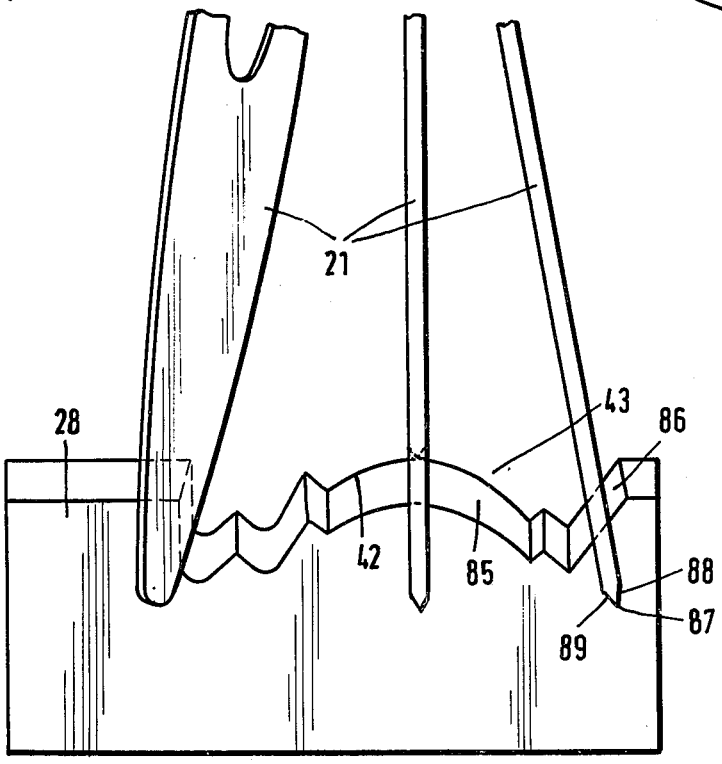

FIG. 8 shows a top view of a profile tool to be ground together with grinding wheels which are in different swivel positions.

The tool grinding machine according to the present invention is characterized primarily in that the headstock is arranged on a swivel support which is adjustable about a swivel axis that is at least nearly parallel to the grinding spindle and passes approximately through the grinding area of the grinding wheel, and in which said swivel support is mounted on a rotary support so arranged on the machine column as to be adjustable about an axis of rotation extending transverse to the common axial plane of the grinding spindle and the swivel axis. The machine according to the invention is furthermore characterized in that the holding fixture is mounted on a support which is pivotally mounted on the machine column, and in that the template is located in a plane passing through the grinding area and containing the profile tool edge to be ground, said grinding wheel being mounted so that it can be swivelled about an axis which is at least approximately vertical to the spindle axis and angular to the axis of rotation and passes through the grinding area.

Figure 1:
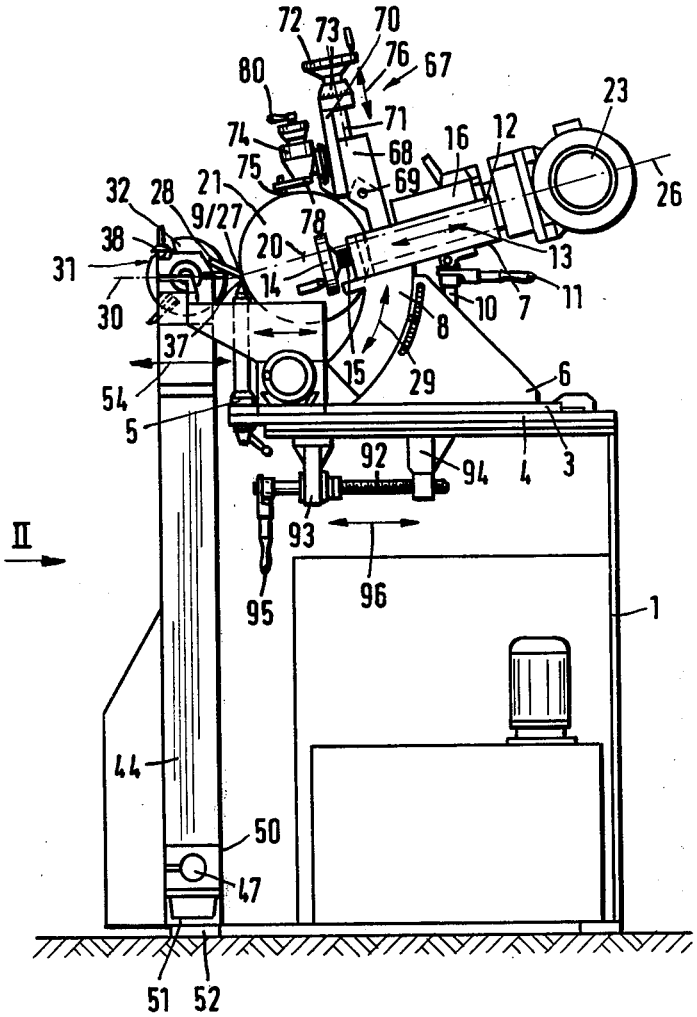
FIG. 1 shows a lateral view of a tool grinding machine according to the invention.
Figure 2:
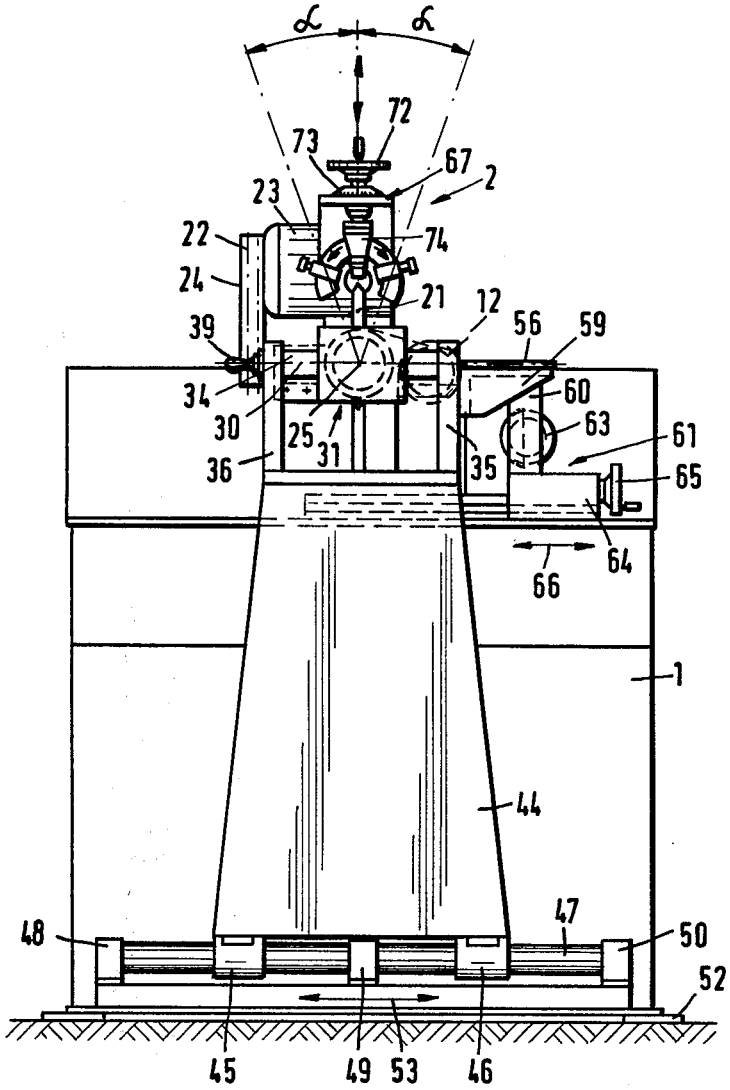
FIG. 2 represents a view taken in the direction of the arrow ii in FIG. 1.
Figure 3:
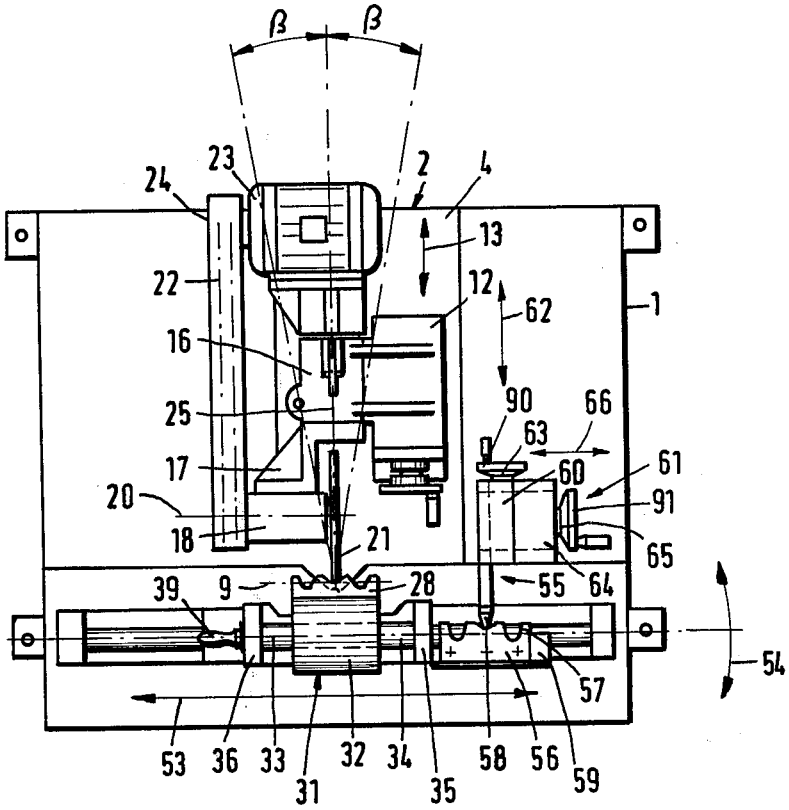
FIG. 3 is a top view of the machine shown in FIG. 1.

Referring now to the drawings in detail, the tool grinding machine shown in FIGS. 1 to 3 comprises a machine column 1, on which a grinding unit 2 is arranged. The grinding unit is mounted approximately in the center of the machine column 1 (FIG. 3). The grinding unit 2 comprises a rotary support 3 which is arranged on a slide rest 4 mounted on the machine column 1. The rotary support 3 is adjustable relative to the machine column about a vertical pivot pin 5 and can be arrested in any desired position. On the rotary support, there is provided a concave circular-segment-shaped guide 6 (FIG. 1), on which a swivel support 7 is mounted with a segmental piece 8, so that it can be adjusted by means of a scale about a horizontal swivel axis 9.

An approximately vertical adjusting spindle 10, which is located at the rear of the segmental piece 8 in spaced relationship to the swivel axis 9 serves for the adjustment of the swivel support 7. The upper end of the adjusting spindle 10 is hinged to the bottom of the swivel support 7, which latter is located above the rotary support 3, and the lower end of said adjusting spindle 10 is hinged to the rotary support 3. The adjusting spindle 10 is rotatable by means of a handle 11 located at the rear of the machine and engages in a spindle nut which is hinged, for example, to the rotary support 3.

On the swivel support 7, there is provided a slide way on which a slide or carriage 12 is mounted so as to be displaceable radially to the swivel axis 9 and transversely to the axis of rotation 5 in the opposite directions indicated by the double arrow 13. The slide 12 is adjustable according to a scale 15 by means of a hand wheel 14 comprising a screw spindle. The swivel support 7 and the slide 12 thus togther form a slide rest.

To the slide or carriage 12 of the swivel support 7, there is secured a cylindrical bearing housing 16, the axis of which is parallel to the longitudinal axis of the slide 12 (FIG. 3). A grinding spindle carrier 17, which projects from the bearing housing at both ends is rotatably mounted in the cylindrical bearing housing 16. To the end of the carrier 17 that projects from the bearing housing 16 in the direction of the front there is secured a spindle headstock 18, in which a horizontally located grinding spindle 19 is rotatably mounted (FIG. 1). The axis 20 is parallel to the swivel axis 9 and is located between the swivel axis 9 and the segmental piece 8. On the grinding spindle 19, there is mounted a preferably flat grinding wheel 21 which is diven by a motor 23 through the intervention of a belt drive 22 (not shown in detail). The motor 23 is arranged at the end of the grinding spindle carrier 17 that projects from the bearing housing 16 in the direction toward the rear of the machine column 1 (FIG. 3). The belt drive 22 is accommodated in a protective case 24.

The grinding spindle carrier 17 together with the spindle headstock 18, the grinding spindle motor 23 and the belt drive 22, is rotatably mounted for rotation about the axis 25 of the bearing housing 16. The grinding spindle carrier 17 can be swivelled from its central position shown in FIG. 4 towards both sides through respectively an angle $\alpha$ (FIG. 2) of up to approximately 20°. The grinding spindle carrier 17 can be arrested in each swivel position with respect to the bearing housing 16.

The axis 20 (FIG. 7) of the grinding spindle 19 and of the grinding wheel 21, and the swivel axis 9 are located in a common plane 26 which is parallel to the direction of adjustment 13 of the slide 12. This direction of adjustment 13 extends at right angles to the grinding spindle 19 and the swivel axis 9. By the adjustment of the slide 12, the grinding wheel 21 can be set in such a way that a point of the rotational path of its mantle coincides with the swivel axis 9 (FIGS. 1,7). This point is located in a grinding area 27, in which the grinding wheel 21 engages the workpiece 28 to be ground. The grinding area 27 is located on that side of the grinding spindle 19 which faces away from the rotary support 3 and the slide 12 and is lower than the axis 20 of the grinding spindle (FIG. 1).

The headstock 18 can be swivelled about the swivel axis 9 in the direction of the double arrow 29 (FIG. 1). In each swivel position, the plane 27 is located at an acute angle opening towards the rear of the rotary support 3 relative to the horizontal axial plane of the swivel axis 9. The grinding unit 2 can be rotated from its central position (FIG. 3) in both directions of rotation respectively through an angle $\beta$ of approximately 10° by rotation of the rotary support 3 about the axis of rotation 5.

The axis 25 is located in the plane 26 and at a right angle to the swivel axis 20 (FIG. 7) when the grinding unit 2 is aligned in the central position as shown in FIG. 3.

The workpieces 28 to be ground are arranged in a holding fixture 31. The holding fixture has a substantially cylindrical carrier 32, which is generally a cutter head and will be designated hereinafter as the clamping body. The axis 33 of the clamping body 32 is horizontal and is located in a plane 30 that is vertical to the axis of rotation 5 and is horizontal. When the grinding unit is aligned in its central position, i.e. when the plane 30 of the clamping body 32 passes through the grinding area 27 of the grinding wheel 21, the axis 33 of the cylindrical clamping body is parallel to the spindle axis 20 and vertical to the axis 25. In this central position, the planes 26 and 30 intersect in the swivel axis 9 and the grinding area 27 (FIG. 7). The clamping body 32 is centrically arranged on a shaft 34 (FIGS. 2,3, and 7), which is rotatably mounted on two supporting pillars 35, 36 (FIGS. 2 and 3), so that the workpiece 28 to be ground can slide off over a supporting finger 37. The upper ends of the supporting finger 37 and the swivel axis 9 are located in the planes 26 and 30 passing through the grinding area 27 of the grinding wheel 21 (FIG. 7).

At their upper ends, the supporting pillars 35, 36 comprise radially movable bearing boxes which with the aid of approximately vertical tightening spindles 38 (FIG. 1) can be so tightened against the ends of the shaft 34 that the clamping body 32 is rotatably secured. The shaft 34 is carried in ball bearings which are free from play. On the outside of the carrying pillar 36, the shaft 34 carries a handle 39, by means of which the upper bearing box can be lifted whereupon after finish-grinding the clamping body 32 can be removed, together with the shaft 34.

The clamping body 32 is a commercially available cutter head with two or more groove-shaped recesses 40 (FIG. 7), which are arranged at equal intervals along its circumference and continue over its length and in which respectively one workpiece 28 to be sharpened can be inserted and be secured with the aid of a chucking wedge 41.

As shown in FIGS. 1 and 7, in its grinding position, the workpiece 28 to be ground is directed obliquely downwards from the clamping body 32 in the direction toward the grinding wheel 21, so that the cutting edge 42 of the profile 43 to be ground from solid material is located approximately in the horizontal plane 30 of the clamping body 32 (FIGS. 7 and 8). The cutting edge 42 and the swivel axis 9 coincide in each grinding position (FIG. 7).

The two vertical supporting pillars 35, 36 are secured to a rocker arm 44 which is arranged in front of the machine column 1 (FIG. 1). With its lower end, the rocker arm is by means of two ball thrust bearings 45, 46 arranged in spaced relationship to each other mounted on a shaft 47 which is supported in pillow blocks 48 to 50 on the machine column 1 (FIG. 2). The pillow blocks are secured to the upwardly directed legs of a U-shaped support 51 (FIG. 1) which is secured to supporting feet 52 of the machine column 1 and which has the same length as the shaft 47 (FIG. 2). The rocker arm 44, which in plan view has a trapezoidal layout (FIG. 2), is displaceable with the ball thrust bearings 45, 46 on the shaft 47 in the direction of the double arrow 53 and can be swivelled about the shaft in the direction of the double arrow 54 (FIG. 1). The rocker arm 44 is thus movable longitudinally and vertically to the grinding wheel 21. When the grinding unit 2 is in its central position, as shown in FIG. 3, the direction of displacement 53 of the rocker arm extends parallel to the spindle axis 20 and the swivel axis 9. The two external pillow blocks 48 and 50 form stops for the ball thrust bearings 45 and 46 when the rocker arm is displaced.

The supporting finger 37 is of plate-shaped design and is secured to the rotary support 3. The vertical pin of the supporting finger 37 is at right angles to the plane of rotation of the rotary support 3 and supports the workpiece 28, which is in the grinding position, on its underside against the grinding pressure in the area of the cutting edge 42. The supporting finger 37 is expediently arranged so that its edge abutting the tool 28 scrapes off the burr which is formed due to the grinding along the cutting edge 42. To the end, the supporting finger is provided with a highly finished surface, for example of carbide, which forms an obtuse-angled cutting edge.

The machine comprises a copying attachment 55 (FIG. 3), by means of which the movements of the grinding unit 2 relative to the holding fixture 31 are controlled in conformity with a template 56. The profiled template edge 57 corresponds to the negative form of the profile to be produced with the workpiece 28. The template edge 57 is traced by a tracer finger or feeler 58.

The plate-shaped template 56 is exchangeably secured to a holder 59 which is secured to the outside of the supporting pillar 35 (FIG. 2). The holder 59 is formed by an angle plate, to one leg of which the template is detachably secured. The holder 59 is so arranged on the carrying pillar 35 that, in its installed position, the template 56 is parallel to the plane of rotation of the rotary support 3. The central plane of the template 56 coincides with the plane 30 of the holding fixture 31, in which the axis 33 of the clamping body 32 and the swivel axis 9 are disposed. Since the template 56 is disposed at the level of the grinding area 27 and the cutting edge 42 of the workpiece 28, a high degree of dimensional precision during the grinding operation is insured. As a result, there do not occur any undesirable profile distortions during the grinding of the profile tool 28.

The tracer finger 58 is exchangeably secured to a slide or carriage 60 of a slide rest with cross and top slides 61 on the machine stand or column 1 (FIG. 3). The slide 60 is mounted on a lower slide 64 of the slide rest so as to be displaceable by an adjustable spindle 63 in the direction of the double arrow 62. The lower slide 64 is so arranged on the machine column 1 as to be displaceable by an adjusting spindle 65 in the direction of the double arrow 66. The lower slide 65 can be displaced parallel to the direction of displacement of the rocker arm 44.

The external contour of the tracer finger 58 has the same profile and the same cross section as the profile grinding wheel 21. This insures that the exact grinding profile is copied during grinding and that the back of the grinding wheel cannot grind the profile contour off in an undesirable manner.

The grinding unit 2 is provided with a dressing device 67 which allows the profile of the grinding wheel 21 to be ground or re-ground. The dressing device comprises a slide rest 68 (FIG. 1) which is mounted, so that it can be pivoted about the pin 69, and is journalled on that end of the grinding spindle carrier 17 which projects from the cylindrical bearing housing 16 in the direction toward the grinding wheel 21. The slide rest 68 is arranged directly behind the grinding wheel 21. On the front portion of slide rest 68 there is mounted a slide 70 which is adjustable by an adjusting spindle 71 at right angles to the axis of rotation of the grinding wheel 21. The upper end of the adjusting spindle 71 carries a hand wheel 72 and a graduated ring 73 (FIGS. 1,2 and 4 to 6). The longitudinal central plane of the slide way for the slide 70 coincides with the central plane of the grinding wheel 21. As FIG. 1 shows, the slide way is slightly inclined to the front in the direction toward the rocker arm 44.

An adjusting body 74 is so mounted on the front of the slide 70 that it can be swivelled about a pin 75 which is approximately tangential to the grinding wheel 21 and at right angles to the direction of displacement 76 of the slide 70. In the adjusting body 74, there is arranged a bearing body 77, on which a diamond holder 78 is pivotally mounted. The swivel axis 79 of the diamond holder 78 is parallel to the direction of displacement 76 of the slide 70.

The diamond holder 78 is located at that front end of the bearing body 77 which faces towards the grinding wheel 21 and is mounted in the bearing body 77 by means of a spindle which is not shown in detail. That end of said spindle which projects upwardly from the bearing body 77 carries a lever 80 serving as handle. At the upper end of the spindle, there is provided a graduated ring 81, according to which the respective position of the diamond holder 78 with respect to the swivel axis 75 can be accurately determined.

The diamond holder 78 is designed in the manner of a radial arm, to which a dressing tool 82 in the form of a diamond is secured in spaced relationship to the swivel axis 79. The diamond point is disposed exactly in the extension of the radial of the grinding wheel 21, which means it is exactly vertical to the axis of the grinding wheel 21. The swivel axis 79 is in the described position in a central position of the adjusting body 74.

The adjusting body 74 can be swung through approximately 180°, i.e. through approximately 90° towards each side from its central position, in which the diamond point has an exactly radial position relative to the axis of the grinding wheel 21. The swivel movement of the adjusting body 74 is limited by two stops 83, 83' which are adjustably and arrestably mounted on an annular segment 84 that is coaxial with the axis 75. The annular segment 84 is arranged on the front side of the slide 70 and lies substantially above the swivel axis 75 and behind the bearing body 77.

The swivel plane, in which the dressing tool 82 can be moved about the swivel axis 79, can in an infinitely variable manner be moved into varying inclined positions by swivelling the adjusting body 74. In this way, it is possible in addition to dressing the mantle, also to dress the rims or flanks of the grinding wheel 21. The point of the dressing tool 82 can be set in such a way that radii or any desired angular forms can be shaped on the grinding wheel.

The graduated ring 73 indicates by how much the diameter of the grinding wheel 21 has been reduced during dressing. Thereafter, the slide 12 has to be adjusted by the same amount according to the graduated ring 15, in order to insure that the grinding area 27 is again situated in the swivel axis 9.

Different positions of the grinding wheel 21 during the grinding of the profile 43 of the workpiece 28 are shown in FIG. 8. In the central position, the grinding unit 2 is in its central position shown in FIG. 3. In this central position, the central plane of the grinding wheel 21 is vertical to the direction of displacement 53 of the rocker arm 44. In the central position, the swivel support 7 can by means of spindle 10 be swung about the swivel axis 9. In this way, it is possible to set the clearance angle on the rear surface 85 of the cutting edge 42 of the workpiece 28. Since the axis 20 of the grinding spindle 21, the swivel axis 9, and the supporting surface of the supporting finger 37 are located in the common plane 26, an adjustment of the supporting finger with respect to the center of the grinding wheel 21 is not necessary when the swivel movement about the swivel axis 9 is effected. Consequently, there is no need for the grinding operation to be interrupted and for the machine to be stopped or be re-adjusted or re-set during the grinding operation.

In the right-hand position shown in FIG. 8, the grinding wheel 21 has been swivelled out of its central position. In order to reach this position, the rotary support 3, on which the grinding unit 2 is arranged, is rotated about the vertical axis 5. In this position of the grinding wheel 21, it is possible to grind the lateral clearance areas 86 of the profile 42. The clearance angles are determined by the angle by which the rotary support 3 is adjusted relative to the central position. As in the central position, the central plane of the grinding wheel is also in this rotated position vertical to the rotary plane of the rotary support 3.

In the left-hand position shown in FIG. 8, the rotary support 3 has been swivelled out of its central position shown in FIG. 3 by rotation about the vertical pivot 5, and subsequently the grinding spindle carrier 17 has been rotated about the axis 25. As FIGS. 4 to 6 show, the grinding spindle carrier 17, together with the headstock 18, the motor 23 and the dresser 67, can be swivelled from the central position shown in FIG. 4 towards both sides about the axis 25. Due to this swivel possibility, large lateral backings can be ground on the workpiece.

In all the described swivel movements of the grinding wheel 21, the grinding area 27 maintains its position with respect to the machine column or stand, so that no readjustments are necessary. This is brought about by the fact that the swivel axes 5, 9 and 25 have a common point of intersection which is situated in the grinding area 27.

As FIG. 8 shows, the grinding wheel 21 is so profiled in the area of its circumference that there is provided a grinding face 87 which is formed by an end face 88 and by the mantle of the grinding wheel. These two surfaces are at acute angles to one another in the grinding wheel cross section. The outside face 88 formed by a frusto-conical section of a grinding wheel end face, in cross section forms an acute angle with the central plane of this grinding wheel and is located at the grinding wheel rim which, when the associated clearance face 86 is worked, lies opposite to this clearance face. The other end face 89 of the grinding face 87 is formed by the frusto-conical mantle of the grinding wheel.

The machine is capable with templates of the ratio 1:1 of pre-grinding and finish-grinding profile tools, such as profile blades and profile cutters, within a short time from solid material and without any preliminary profiling. The back and the desired and required lateral clearance angle is ground on the tools. The profile distortion caused by the rake angle on the tools is automatically ground in in the course of the grinding operation. Prior to the grinding operation, the entire dressing device 67 is swivelled to the rear about the axis 69, in order to allow a guard (not shown) to be placed over the grinding wheel. For the basic setting of the grinding wheel 21, the slide 12 is fed in with the aid of the hand wheel 14 in such a way that in its central position or in the selected rotated position, the grinding wheel is situated with its grinding area 27 in the swivel axis 9. To this end, the grinding wheel 21 is so set that its mantle is spaced by approximately 0.5 mm from the supporting finger 37. If the grinding wheel is re-profiled, a reading on the graduated ring 73 indicates by how much the grinding wheel diameter has been reduced during dressing. The slide 12 has then with the aid of the hand wheel 14 to be displaced by the same amount in the direction toward the rocker arm 44, in order to insure that the grinding area 27 is again situated in the swivel axis 9. In this way the grinding area is always situated on the swivel axis 9.

The desired template 56 is fastened on the holder 59 of the copying attachment 55. The rocker arm 44 is via a drive (not shown) set in such a way that it is vertical, as shown in FIG. 1. In this way, it is possible to reach a high degree of adaptation accuracy and no profile deviations will occur during the grinding of the profile tool. The tracer finger 58 is set, according to the template 56, in such a way that it is located in the center of the profile depth to be ground (FIG. 3). To this end, the slide 60 of the slide rest with cross and top slides 61 is displaced in the direction 62 with the aid of the hand wheel 90 provided on the adjusting spindle 63, until the tracer finger 58 assumes the desired position. Furthermore, the rotation of a hand wheel 91 arranged on the adjusting spindle 65 allows the lower slide 64 to be adjusted in the direction 66 parallel to the direction of isplacement 53 of the rocker arm 44. With the aid of the slide rest 61, the tracer finger 58 can be exactly guided to the required position.

After the setting of the rocker arm 44 and the copying attachment 51, the grinding unit 2 has to be set in such a way that the workpiece 28 is located in the grinding wheel 21 as far as half the profile depth (FIG. 3). This can be checked by driving laterally against the grinding wheel 21. To this end, the rocker arm 44, while maintaining its vertical position, is displaced on the shaft 47 in the direction of the arrow 53 with the aid of a drive (not shown).

For the adjustment of the grinding unit 2 on the machine stand or column 1, beneath the rotary support 3, there is provided an adjusting spindle 92 (FIG. 1) which is rotatably supported in two pillow blocks 93, 94. The pillow block 93 is stationarily secured to the machine column 1, and the pillow block 94 is secured to the bottom of the slide rest 4. A handle 95 is provided at the front end of the adjusting spindle 92. Rotation of the adjusting spindle 92 causes the slide rest 4, together with the grinding unit 2 installed thereon, to be displaced in the direction of the arrow 96. By means of spindle 92, the grinding unit 2 can thus be displaced on the machine column 1 in such a way that, with the rocker arm 44 in a vertical position, the grinding wheel 21 has the afore-described position relative to the workpiece 28, which position is required for grinding.

After setting the grinding wheel, the rocker arm and the copying attachment 55, grinding can be effected. For rough-grinding, the grinding wheel 21 is trued at a radius which corresponds to half the width of the grinding wheel. After rough-grinding, the grinding wheel is changed and a grinding wheel of finer grain is used, by means of which the profile is then finish-ground. For finish-grinding, the profile shown in FIG. 8 is used. On the right hand section (when viewing FIG. 8) of the workpiece 28, the grinding wheel is profiled as shown in FIG. 8. When the left-hand section shown in FIG. 8 is worked, the profile of the grinding wheel is formed as an image to that of the right-hand section. The respective profile of the grinding wheel can be produced within a short time with the dressing device 67. Since the dressing device is connected to the grinding unit 2 in a rotation-proof manner, thus following every swivel movement of the latter, the dressing device or the dressing tool 82 has in each swivel position the position that is correct for the profile of the grinding wheel 21 to be ground. Since the workpiece 28 to be ground is not arranged on a slide rest with cross and top slides but is arranged on the swingably and displaceably mounted rocker arm 44, wet grinding can be effected with this machine, for example with oil or water. In this way it is possible to achieve a high grinding output, so that the desired profiles can be ground within a short time from solid material without any preliminary machining. Due to the high grinding output, the grinding wheel changes taking place during the production of a profile tool are practically irrelevant.

All the grinding operations occuring during the grinding of profile tools can be performed on the machine without any need to unclamp the profile tool to be ground. The profile tool is finish-ground on the machine, so that no subsequent manual work is required. The machine is suitable for grinding not only profile tools for working wood, plastics material and similar materials but also for metal-working profile tools. Here, too, it is possible to grind the respective profile from the solid material on the machine.

As will be seen from the above, due to the design according to the invention, complicated profiles can be rough-and finish-ground from solid material within a short time without any preliminary profiling. The rotation of the headstock about the axis of rotation allows the grinding wheel to be set in a simple manner to the lateral clearance angles of the profile to be ground. Since the grinding wheel can furthermore be swivelled about the swivel axis that is approximately vertical to the spindle axis and angular to the axis of rotation, it is possible to grind a very large lateral backing on the profile of the profile tool. The rotation of the headstock about the swivel axis allows the clearance angle of the profile tool edge back surface to be varied. The swivel axis passes through the grinding area, so that the position of the grinding area is not changed when the headstock is swivelled. In this connection, the profile tool may be arranged obliquely to the template at an angle which corresponds to the cutting angle of the profile tool during the working of the workpiece to be profiled. In this way, the profile of the tool to be ground is relative to the profile of the template automatically given those distortions which are required by the cutting angle of the profile tool to be ground during the profiling of a workpiece, so as to ensure that the workpiece is given the same profile as the template. The profile of the template may, therefore, equal in full size the profile which is to be produced with the profile tool. The profile distortion caused on the tools by the rake angle is thus automatically co-ground in the course of the grinding operation. The grinding machine according to the invention allows wet grinding, for example with water or oil, so that a high grinding output is achieved.

Consequently, the desired profiles can be ground from solid material within a relatively short time. This is possible due to the fact that the holding fixture is arranged on the support which is pivotally mounted on the machine stand or column. No complicated slide rest is provided for the holding fixture, in contrast to heretofore known machines where wet grinding is not possible without damaging the precise guiding of the slide rest. Over and above this, the swivel support is substantially simpler in design than the complicated compound slide rests are, which have to be manufactured in a very precise manner in order to obtain the desired high dimensional accuracy. Since the template is located in the plane passing through the grinding area and containing the profile tool edge to be ground, a high degree of dimensional accuracy is ensured for the grinding of the profile tool.

It is, of course, to be understood that the present invention is, by no means, limited to the specific showing in the drawing but also comprises any modifications within the scope of the appended claims.

What we claim is:

1. A tool grinding machine for profile tools, especially for wood working and plastic material working machines, which includes in combination: a machine stand, at least one headstock arranged on said machine stand and comprising a grinding spindle and a grinding wheel thereon, a holding fixture provided for the profile tools to be ground and located opposite to a grinding area provided at a point of the rotational path of the grinding wheel, a copying attachment comprising a template to be arranged on a holder and also comprising a feeler arranged on said machine stand for engaging said template, a swivel support carrying said at least one headstock and being adjustable about a swivel axis at least nearly parallel to said grinding spindle and passing at least approximately through the grinding area of said grinding wheel, a pivot extending transverse to the common axial plane of said grinding spindle and said swivel axis, a rotary support supporting said swivel support and being arranged on said machine stand so as to be adjustable about said pivot, a carrier supporting said holding fixture and being pivotally mounted on said machine stand, said template being located in a plane passing through said grinding area and incorporating the edge of the profile tool to be ground, said grinding wheel being so mounted as to be adapted to be swivelled about an axis extending at least approximately at right angles to the spindle axis and inclined to the axis of rotation and passes through said grinding area, said carrier for the holding fixture being mounted on said machine stand so as to be displaceable approximately parallel to the axial direction of said grinding spindle, said grinding unit and said dressing device being mounted on said machine stand so that they can be displaced approximately vertically to the direction of displacement of said carrier for the holding fixture.

2. A machine in combination according to claim 1, in which said carrier is mounted on said machine stand so as to be able to swivel about a shaft which is approximately vertical to said pivot of the rotary support.

3. A machine in combination according to claim 2, which includes bearings supporting said carrier and in which said carrier by means of said bearings is displaceably and pivotally mounted on said axis which is journalled in the lower region of said machine stand.

4. A machine in combination according to claim 2, in which the holder for said template is arranged on said carrier.

5. A machine in combination according to claim 1, in which a dressing device is mounted on said grinding unit so as to be adapted to be swivelled about an axis approximately parallel to said spindle axis.

6. A machine in combination according to claim 5, which includes a driving motor for said grinding spindle, and in which said grinding unit together with said headstock and said driving motor as well as said dressing device is adapted to be swivelled about the axis which is vertical to the spindle axis.

7. A machine in combination according to claim 1, which includes a cylindrical bearing arranged on said swivel support, and in which said spindle carrier of said headstock is pivotally mounted on said cylindrical bearing.

8. A machine in combination according to claim 7, in which said grinding unit and said dressing device is adapted to be swivelled about the axis of said bearing toward both sides over respectively an angle area $\alpha$ of approximately 20°.

9. A machine in combination according to claim 1, in which said swivel axis which is vertical to the spindle axis is situated in a radial central plane of said grinding wheel.

10. A machine in combination according to claim 1, which includes a slide rest with cross and top slides on said machine stand, and in which said feeler of said copying attachment is mounted on said slide rest.

11. A machine in combination according to claim 10, in which said slide rest includes two slides mounted on said machine stand so that they can be displaced vertically and parallel to the direction of displacement of said carrier of said holding fixture.

* * * * *